United States Patent [19]

Clausen et al.

[11] Patent Number: 4,708,311

[45] Date of Patent: Nov. 24, 1987

[54] SLOT BOARD HANGING APPARATUS AND METHOD

[75] Inventors: Eivind Clausen; Michael G. Allsop, both of Bellingham, Wash.

[73] Assignee: Allsop, Inc., Bellingham, Wash.

[21] Appl. No.: 816,893

[22] Filed: Jan. 7, 1986

[51] Int. Cl.[4] ..... A47F 5/08

[52] U.S. Cl. ..... 248/222.2; 248/225.1; 211/87

[58] Field of Search ..... 248/225.1, 220.2, 220.3, 248/220.4, 224.3, 224.4, 221.2, 222.2, 222.1, 223.1, 223.4, 224.1, 224.2; 211/59.1, 70.6, 87, 94

[56] References Cited

U.S. PATENT DOCUMENTS

| | | | |
|---|---|---|---|
| 23,286 | 12/1844 | Oliver . | |
| 674,489 | 5/1901 | Wall . | |
| 1,939,867 | 12/1933 | Thompson . | |
| 2,430,302 | 11/1947 | Ringler . | |
| 2,749,153 | 6/1956 | Baker . | |
| 2,841,353 | 7/1958 | Burdick . | |
| 2,901,144 | 8/1959 | Haustrup . | |
| 2,913,210 | 11/1959 | Tichnor . | |
| 2,961,724 | 11/1960 | Alling . | |
| 3,014,597 | 12/1961 | McWherter . | |
| 3,235,218 | 2/1966 | Graham | 248/220.3 |
| 3,269,550 | 8/1966 | Marcus . | |
| 3,392,949 | 4/1967 | Meyer, Jr. . | |
| 3,409,260 | 4/1967 | Bleed . | |
| 3,477,677 | 11/1969 | Hindley . | |
| 3,502,294 | 3/1970 | Kalbow et al. . | |
| 3,656,727 | 4/1972 | Greenlee . | |
| 3,669,034 | 6/1972 | Marschak . | |
| 3,737,131 | 6/1973 | Larson . | |
| 3,941,343 | 3/1976 | Kennedy | 248/220.3 |
| 4,111,297 | 9/1978 | Paulin . | |
| 4,113,009 | 9/1978 | Meyer et al. . | |
| 4,213,559 | 7/1980 | Meyers . | |
| 4,319,531 | 3/1982 | Caldwell . | |
| 4,509,648 | 4/1985 | Govang | 248/220.2 |
| 4,591,058 | 5/1986 | Amstutz | 248/220.2 |

FOREIGN PATENT DOCUMENTS

| | | | |
|---|---|---|---|
| 1472212 | 1/1967 | France | 248/220.3 |

*Primary Examiner*—Reinaldo P. Machado
*Assistant Examiner*—Alvin Chin-Shue
*Attorney, Agent, or Firm*—Hughes & Cassidy

[57] ABSTRACT

A conventional J-hook is mounted to a slot board by means of an adapter having a front plate fitting against the slot board and a mounting element extending into a slot of the slot board. The J-hook has a right angle finger portion, comprising a laterally extending member which fits in an upper horizontal recess formed in the front plate and mounting portion of the adapter, and an upper finger retaining portion which extends behind the flange defining the slot. The adapter maintains the J-hook in a proper position so that it will not inadvertantly be pulled loose from the slot board by, for example, a lateral and downward force being exterted on the J-hook.

18 Claims, 14 Drawing Figures

FIG. 1
Prior Art
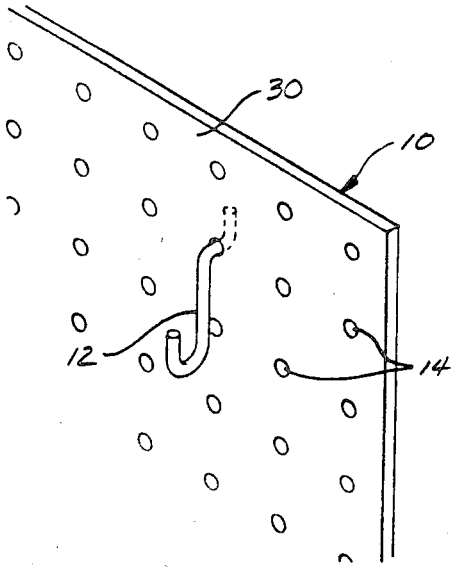
FIG. 2 - Prior Art
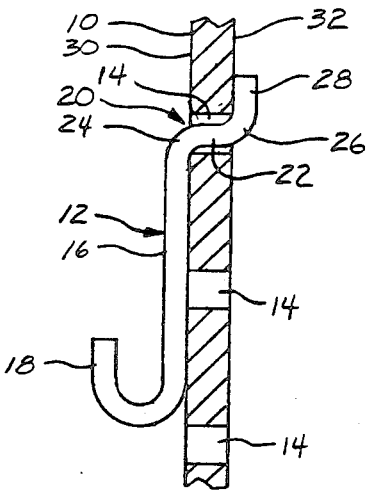
FIG. 3 - Prior Art
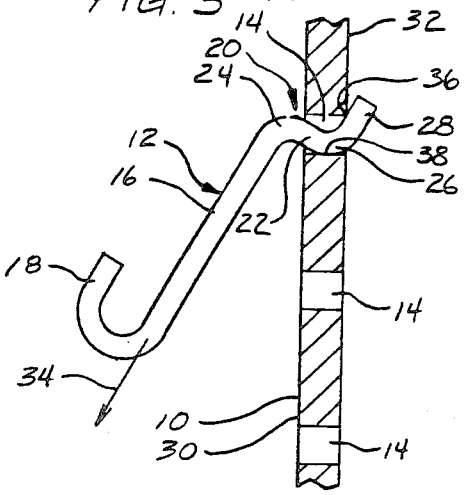

FIG. 13
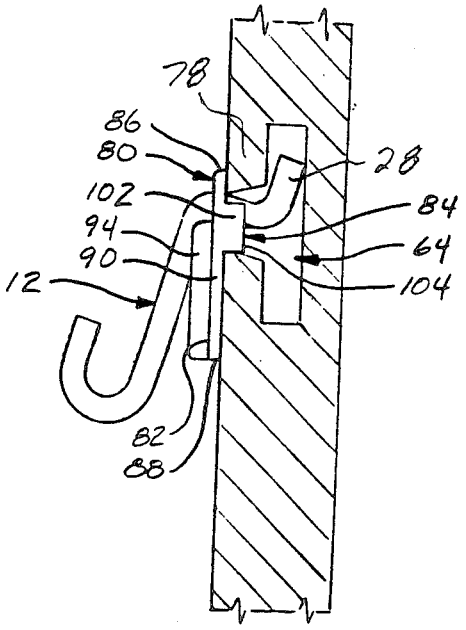
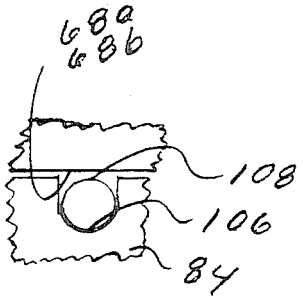
Fig 14

SLOT BOARD HANGING APPARATUS AND METHOD

BACKGROUND OF THE INVENTION

1. Field of the Invention

The present invention relates to a mounting assembly for various objects, such as a mounting assembly by which products, such as products for sale, can be mounted for display and easy access, and more particularly, for such an assembly which is adapted for use in conjunction with a slot board, but which will also permit use in conjunction with a pegboard.

2. Background Art

For years, a convenient and inexpensive method of mounting objects for display and/or ready access has been by the use of pegboards. These pegboards are commonly mounted from a vertical wall surface, with the pegboards spaced a short distance outwardly from the wall surface so as to leave a shallow open area between the rear surface of the pegboard and the wall surface. The pegboard has a plurality of through openings, generally in a regularly spaced rectangular pattern. Objects are commonly mounted to the pegboard by means of J-hooks. A typical J-hook has a downwardly extending shank which terminates in a lower hook portion that can be attached to the objects. The upper end of the shank has a right angle securing portion, having a first connecting portion extending laterally from the upper end of the shank, and an upstanding retaining finger extending upwardly from the rear end of the connecting portion. The J-hook is inserted into the pegboard by first positioning the shank portion generally horizontally, and then directing the finger portion into a selected opening in the board. The J-hook is then rotated downwardly as the finger and its related connecting portion are moved further inwardly through the opening in the board until the shank of the J-hook extends downwardly so as to be positioned adjacent the front face of the pegboard, with the retaining finger extending upwardly so as to engage a rear surface of the pegboard above the pegboard opening in which the J-hook is mounted.

One of the problems with a pegboard is that it is sometimes desirable to suspend an object from two spaced locations. For example, it may be desirable to suspend a package from a pegboard by supporting the package at two end locations, and the width of the package does not match the spacing of the pegboard openings.

Accordingly, as an alternative for pegboards, slot boards have been developed. The slot board generally has a plurality of horizontally extending, vertically spaced slots extending the length of the board. Each slot is formed by an upper and lower flange positioned at the front face of the board, with the flanges defining the lateral portion of the slot. In addition, the board is generally recessed at locations rearwardly of the upper and lower flanges. Thus, in cross-section, the slot has the overall configuration of a "T", with the T being positioned on its side, so that the leg of the T extends outwardly to form the horizontally extending portion of the slot, and the two extensions of the T forming the areas behind the upper and lower flanges.

In other configurations, the slots of the slot board may be formed as right angle slots. In this arrangement, there is the laterally extending slot portion which extends rearwardly from the front face of the board, and then an upstanding recessed portion which extends upwardly and behind an upper flange. In this configuration, there is no lower flange as such, but the lower portion of the slot is defined by a single lower planar surface.

When the J-hook is used to mount an object in a slot board, there is not the problem of attempting to match the J-hook with the particular opening (as in the pegboard), since the J-hook can be moved to any selected location along the length of the slot. However, the mounting of the J-hook in the slot is somewhat unstable, in that the J-hook can twist sideways (possibly due to some jostling or movement of the package by a person examining the same) so that the J-hook twists out of the slot.

However, if the J-hook is modified so as to give it stability in being mounted to a slot board, then there are problems in mounting this same J-hook to a pegboard. This can create confusion and inconvenience in having different types of hanging devices, depending upon the board which is used.

Another difficulty is that, depending upon the nature of the object being mounted to the board, the J-hook is not always vertically aligned relative to the surface of the board. For example, let it be assumed that an object having a generally box-like configuration is mounted to the board by attaching two J-hooks to opposite ends of the packag at upper rear corners thereof. The weight of the box will tend to rotate the box outwardly from the board with the lower rear edge of the box as the pivot location. Thus, the upper rear edge portion of the box tends to pull away from the board, thus pulling the shank of the J-hook outwardly at a douwnward and outward slant from the pegboard or slot board. This outwardly slanted position of the J-hook becomes particularly problematical with the hook being mounted to a slot board, since this aggravates the problem of moderate sideways twisting of the J-hook causing it to come loose from the board.

The prior art has, of course, a great number of mounting devices which can be used for various applications, and a search of the patent literature has revealed some of these. These are as follows:

U.S. Pat. No. 2,841,353—Burdick shows what is called a hook fastener, where there is a hanger member 16 which is mounted in a slot of a board, and a hook element which is mounted to the hanger 16 and the board. The hanger member has upper and lower portions which engage the front face of the board both above and below the slot, and there is a pair of finger portions which extend downwardly into the slot to engage the rear surface of the board immediately below the slot. The hook member has a horizontal arm 62 which extends outwardly from the board to provide support, and the hook member further has a rear right angle finger portion which reaches laterally into the slot and then upwardly behind the rear surface of the board above the slot. Further, the hanger member defines a right angle recess to receive a vertical arm portion that interconnects the right angle finger portion with the rear end of the elongate support member, and also to engage the rear part of the horizontal support member.

U.S. Pat. No. 2,913,210—Tichnor shows a display support member where right angle connecting elements fit into a pegboard.

U.S. Pat. No. 2,961,724—Alling shows a device for attaching objects to a board, where there is a member having a general configuration of a J-hook, and there is another member having a body portion wrapped partly around the vertical shank of the J-hook, this member having a lower extension to engage an opening below an opening into which the right angle finger portion of the J-hook is inserted.

U.S. Pat. No. 3,014,597—McWherter shows what is called a "hanger board" where there is a combination of pegs and slots. A support member has a pair of right angle finger members, one of which fits in a peg, and the other of which fits into a slot.

U.S. Pat. No. 3,269,550—Marcus illustrates a rack to be mounted to a pegboard. This rack has upper right angle finger elements to engage the board.

U.S. Pat. No. 3,392,949—Meyer, Jr. et al shows a device to mount shelves or the like to a pegboard. The mounting device has a general configuration of a J-hook, but with the lower end of the hook having an elongate support member. Mounted to the hook is a second member which is adapted to engage one or more holes in the board, other than the hole into which the right angle finger portion of the J-hook is mounted.

U.S. Pat. No. 3,409,260—Bleed shows a connector where there are two right angle finger members engaging two spaced openings in a pegboard. This member is pivotally attached to another member that has a horizontally extending mounting arm.

U.S. Pat. No. 3,477,677—Hindley shows a device somewhat similar to the above-mentioned Alling patent, U.S. Pat. No. 2,961,724, in that there is a support member having shank, a lower end hook and a right angle finger portion. There is a catch member made of resilient steel which has a plate-like portion that bears against the front of the pegboard, and a pair of arms which resiliently grip the shank.

U.S. Pat. No. 3,502,294—Kalbow et al discloses a device to provide a horizontal mounting surface. There is a main mounting member having a generally right angle configuration, and this is attached to the board by a member having two right angle finger portions to fit a pair of holes in the board, with a horizontal retaining member joining the two hook members.

U.S. Pat. No. 3,656,727—Greenlee shows a device to mount a box, and the device has a generally wire frame configuration. There are two right angle finger members adapted to engage a pegboard.

U.S. Pat. No. 3,669,034—Marschak shows a device to hang a shelf from a pegboard where two side retaining elements are each inserted into upper and lower holes in the pegboard.

U.S. Pat. No. 3,737,131—Larson shows a shelf-like support structure where there are a plurality of right angle tabs or fingers which fit into holes in a pegboard.

U.S. Pat. No. 4,319,531—Caldwell shows a shelf mounting system where there are right angle finger members that fit into a vertical support board.

U.S. Pat. No. Re. 23,286—Oliver shows a securing device to mount an object, such as a plate, to a lower plate. There is a mounting finger having a triangularly shaped spring-like member which fits through an opening in the base plate.

In the search that disclosed the patents noted above, a number of other patents were cited. It is believed that these are no more relevant that the patents noted above, or possibly less relevant to the concept of the present invention, so these are simply being listed below. These are:

U.S. Pat. No. 674,489—Wall
U.S. Pat. No. 1,939,867—Thompson
U.S. Pat. No. 2,430,302—Ringler
U.S. Pat. No. 2,749,153—Baker
U.S. Pat. No. 2,901,144—Haustrup
U.S. Pat. No. 4,111,297—Paulin
U.S. Pat. No. 4,113,009—Meyer at al
U.S. Pat. No. 4,213,559—Meyers

SUMMARY OF THE INVENTION

The mounting assembly of the present invention is adapted to support objects, such as objects for display or convenient access. This assembly comprises a slot board having a generally vertically aligned front face and defining at a slot location a horizontal retaining spot opening to said front face. The board has a downwardly extending upper flange at said front face, said flange having a first downwardly facing upper surface defining an upper portion of the slot, and a second rear surface extending upwardly from the first surface with a substantial vertical component of alignment. The board has a third lower surface spaced below the first surface and defining a lower limit of the slot. The slot has a height dimension extending from the third surface to the first upper surface, and a width dimension extending from the front face at a location of the flange to the second surface.

There is a hanging member adapted to be mounted to the board at the slot location. The hanging member is a substantially rigid member and comprises:

1. an elongate shank having a lengthwise axis and adapted to be extending downwardly from the slot location of the board when the hanging member is in its operating position relative to the board, said shank having an upper end and also a lower end which is arranged to attach to an object to be supported;
2. an interconnecting portion having a first end connecting to the upper end of the shank and extending laterally therefrom to a second end of the interconnecting portion, said interconnecting portion having a major alignment component perpendicular to the lengthwise axis of the shank;
3. a retaining finger having a lower end connecting to the second end of the interconnecting portion and extending upwardly therefrom, said finger having a lengthwise axis having a major alignment component perpendicular to said interconnecting portion.

There is a substantially rigid adapter to interfit with the slot board and the hanging member so as to securely mount the hanging member to the board. This adapter comprises:

1. front plate means adapted to be positioned forwardly of the front face of the board at the slot location, and comprising an upper plate means portion to engage the front face of the board above said slot, and a lower plate means portion adapted to engage the front face of the board below said slot;
2. a mounting member fixedly connected to the plate means and extending rearwardly therefrom, said mounting member having a lower surface adapted to bear against said third lower surface of the slot board, said mounting member having an upper portion positioned adjacent to said first upper surface of the board.

The plate means and the upper portion of the mounting member define a forwardly to rearwardly extending, open, horizontal recess configured to receive the interconnecting portion of the hanging member in a manner to restrain lateral movement of the interconnecting portion and so as to position the interconnecting portion adjacent to the first upper surface of the slot board.

With the assembly described above, the adapter can be positioned at the slot location with the plate means bearing against the front face of the board and with the mounting member being positioned in the slot with the lower surface of the mounting member bearing against the third surface of the slot board. The hanging member is then positioned relative to the adapter and the slot board so that the shank extends generally downwardly from the slot location, and the interconnecting portion is positioned within the longitudinal recess. The finger extends upwardly adjacent the rear surface of the flange, in a manner that downward forces exerted on the lower end of the shank having a lateral force component are resisted by interengagement of the interconnecting portion with the adapter and the finger with the flange of the slot board.

In the preferred form, the lower plate means portion defines a vertically aligned groove positioned and configured to extend downwardly from a forward end of the horizontal recess so as to receive therein a shank. This lower plate portion is, in the preferred embodiment, provided with vertically aligned ridge means defining the groove.

In the preferred form, the mounting member has a horizontal thickness dimension extending from a rear surface of the plate means to a rear end of the lower surface of the mounting member. The horizontal thickness dimension is at least approximately one-half of the height dimension extending from the first upper surface to the third lower surface.

The mounting member has an upper surface, and a vertical distance from the lower surface to the upper surface of the mounting member is only moderately less than a vertical dimension between the first upper surface and the third lower surface of the board. Thus, with the adapter in its operating position, vertical movement of the adapter relative to the slot is restrained.

Further, the present invention is directed toward the mounting adapter, particularly adapted to be used in combination with the slot board and the hanging member as described above.

In the method of the present invention, a slot board, a hanging member and an adpater are provided as described above. The adapter is positioned at the slot location with the plate means bearing against the front face of the board and with the mounting member being positioned in the slot, as described above. The hanging member is positioned relative to the adapter and the slot board as described above. In this position, objects can be connected to and suspended from the hanging member, with the hanging member being held securely in place.

Other features of the present invention will become apparent from the following detailed description.

BRIEF DESCRIPTION OF THE DRAWING

FIG. 1 is an isometric view of a prior art slot board having a prior art J-hook mounted thereto;

FIG. 2 is a sectional view taken through the slot board of FIG. 1, showing the J-hook mounted therein;

FIG. 3 is a view similar to FIG. 2, showing the J-hook being pulled outwardly to a moderate degree;

FIG. 13 is a view similar to FIG. 12 showing the J-hook-like hanging member being pulled outwardly from the board to a moderate exent; and FIG. 14 is a sectional view taken along line 14—14 of FIG. 12.

DESCRIPTION OF THE PREFERRED EMBODIMENT

Figure 4:
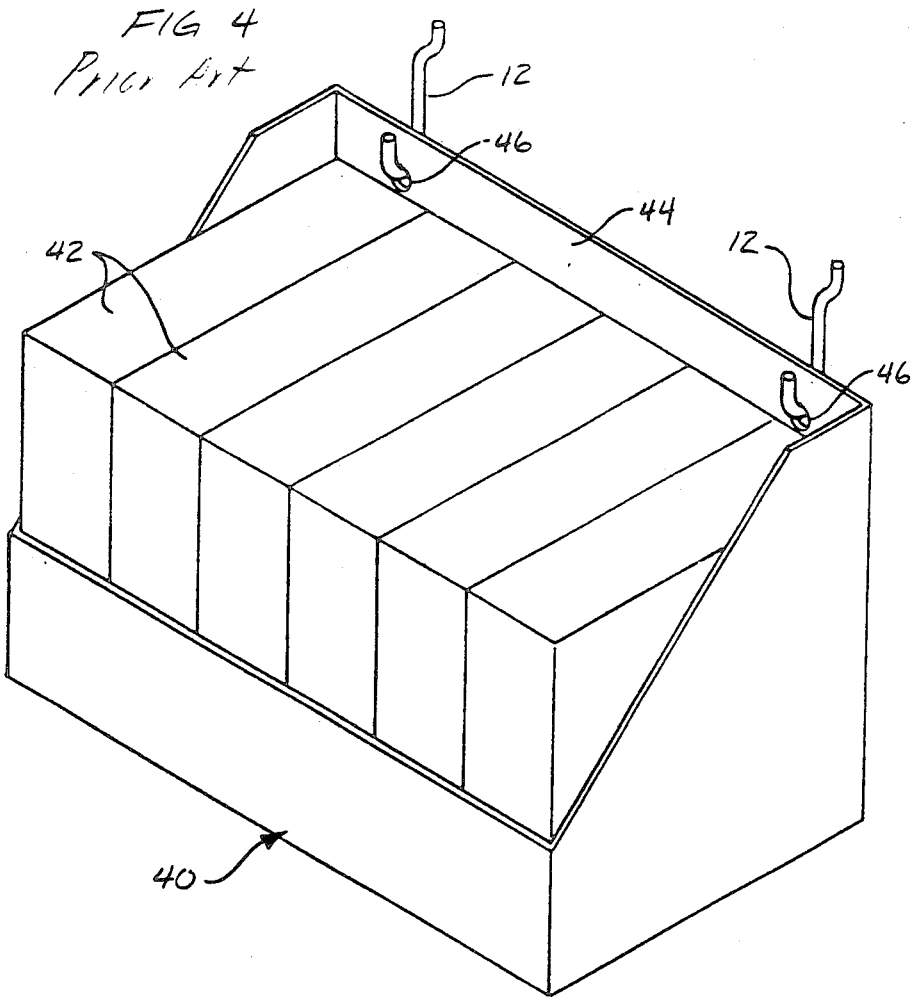
FIG 4 Prior Art
FIG. 4 is an isometric view of a prior art arrangement illustrating a pair of J-hooks carrying a container.

In FIG. 1, there is shown a conventional pegboard 10 having a conventional prior art J-hook 12 mounted thereto. The pegboard 10 has a plurality of through openings 14 spaced in a regular rectangular pattern over the length of the board.

The J-hook 12 is formed from a cylindrical piece of solid metal stock having a diameter of, for example, $\frac{1}{8}$ of an inch. This J-hook has a straight shank 16 of moderate length (e.g. 1.5 inches) at the lower end of which is an upturned hook 18, which, for purposes of description, will be considered as extending forwardly form the shank 16. Integrally connected to the upper end of the shank 16 is what can be described as a right angle connecting member 20. This member 20 comprises an interconnecting member 22 which is a relatively short straight section connected at its forward end at 24 to the upper end of the shank 16. The rear end of the member 22 is connected at 26 to an upstanding retaining finger 28. Since there are certain limits to the sharpness of the bends which can be imposed on a piece of metal stock (e.g. steel of reasonable strength), the interconnecting portions at 24 and 26 are rounded to some degree as they are contoured arcuately around a relatively short bend radius.

The J-hook is inserted into a selected opening 14 of the board 10 by placing the shank 16 laterally and inserting the finger 28 into a selected opening 14. As the interconnecting member 22 comes into contact with the front surface 30 of the board 10, the shank 16 is rotated downwardly so that the finger 28 moves upwardly above the level of the opening 14. When the shank 16 has moved to a full vertical position, the shank 16 is positioned against the board front surface 30, and the retaining finger 28 extends upwardly and immediately adjacent to the rear surface 32 of the board 10 just above the selected opening 14, as shown in FIG. 2.

In this attached position, the J-hook 12 will normally remain secure to the board 10 unless the force applied to the hook portion 18 has a quite substantial alignment component perpendicular to the board 10. As illustrated in FIG. 3, there is shown a force (indicated by the arrow 34) exerted downwardly with a moderate outward slant from the vertical of about 30°. However, the finger 28 remains in bearing engagement with an upper rear edge of the opening 14, and the curved connecting portion 26 between the member 22 and the finger 28 bears against a lower surface portion 38 of the cylindrical surface that defines the hole 14. It is only when the force 34 is exerted in a more horizontal direction that the finger 28 is pulled free of the opening 14.

In some instances, two or more J-hooks are used to mount an object, such as the display container shown in FIG. 4. As illustrated in FIG. 4, there is a display container 40 in which are placed a number of boxes 42. Formed in the rear wall 44 of the container 40 are two mounting holes 46 to receive the hook portions of two J-hooks 12.

Figure 5:
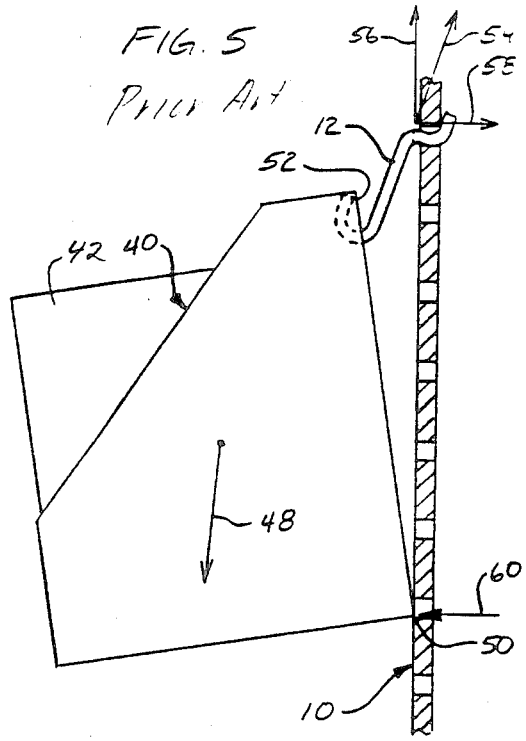
FIG. 5 Prior Art
FIG. 5 is a side elevational view of the container of FIG. 4, showing the container mounted to a slot board, which is shown in section.

However, as illustrated in FIG. 5, there will be some tendency for the upper part of the box container 40 to move away from the pegboard 10. The weight of the box acts about its center of gravity, and this is represented in FIG. 5 by the force component 48. This force 48 will tend to rotate the container 40 about its lower rear edge 50 which bears against the pegboard 10. This causes the upper rear edge 52 of the container 40 to swing outwardly to a moderate extent, but, this outward movement is resisted by the action of the J-hooks 12, since in moving outwardly to a moderate extent, it then exerts a force which pulls upwardly and inwardly (this force component being illustrated at 54). At a certain position, these forces come into equalibrium. More particularly, the force 54 exerted by the J-hook 12 has a vertical force component 56 which counteracts the force 48 which represents the weight of the container 40 and its contained product 42. The J-hook 54 exerts a lateral force component 58 which counteracts a lateral force 60 exerted from the pegboard 10 at the lower edge location 50 of the container 40. Normally, the angle of the J-hook 12 with the vertical is not great enough to cause the J-hook 12 to become dislodged from the pegboard 10.

However, there is another problem in that the spacing of the mounting holes 46 of the container 40 may not match the spacing of the openings 14 of the pegboard 10. If the mismatch is bad enough, it may not be possible to hang the box as illustrated in FIG. 4. At best, the J-hooks will be mounted at a sideways slant which is not the most desirable mounting arrangement.

Figure 6:
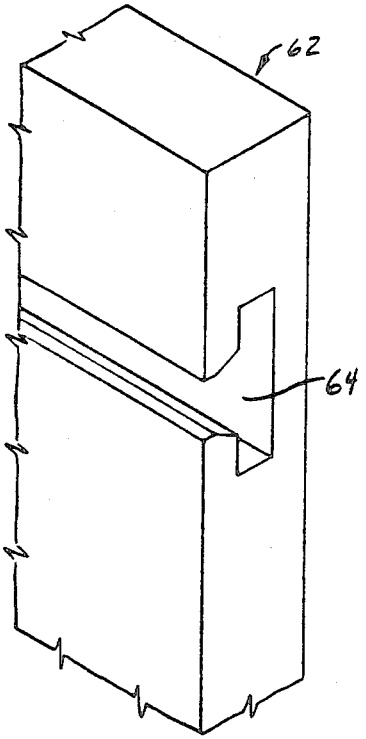
FIG. 6 Prior Art
FIG. 6 is an isometric view of a portion of a prior art slot board.
Figure 7:
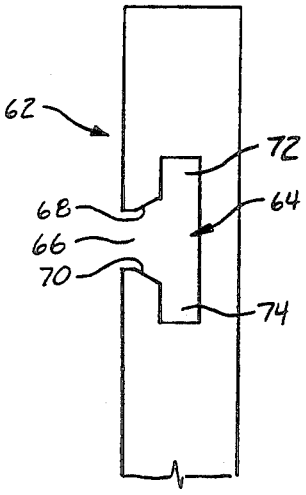
FIG. 7 Prior Art
FIG. 7 is a side elevational view of the slot board of FIG. 6.

As an alternative to mounting objects to a pegboard, there have been provided in the prior art slot boards, such as shown in FIGS. 6 and 7 at 62. Such slot boards 62 commonly provide a plurality of vertically spaced slots 64. As shown in FIG. 7, the slot 64 will commonly have a front open portion 66 defined by upper and lower rear walls 68 and 70, respectively. Rearwardly of the front slot opening portion 66, the slot has upper and lower extensions 72 and 74. Thus, the slot 64 has an overall T-shaped configuration, with the "T" lying on its side. The opening portion 66 forms the leg of the "T", while the upper and lower recessed portions 72 and 74 form the oppositely extending arms of the "T".

The obvious advantage of the slot board 62 is that it can receive the hanging or mounting device at any location laterally along the board 62 (thus alleviating the above-described problem relating to the spacing of the holes 14 in the pegboard 10). Also, conventional J-hooks 12 can be mounted in the slot 64 of the slot board 62. However, there is some degree of unreliability in the use of a J-hook in the slot 64. If the J-hook 12 is pulled downwardly and forwardly, with no lateral tilting of the J-hook 14, then it would be expected that the J-hook 14 would react in substantially the same manner as in a pegboard, as illustrated in FIG. 3. However, in some instances, there is a moderate twisting or lateral tilting of the J-hook 14. With the pegboard, this would not create a problem, but this is not so with the slot board 62. Such tilting or twisting would cause the upright finger 28 of the J-hook 12 to move laterally and thus downwardly relative to the slot opening 66 so as to have more of a tendency to slip out of the slot 64. For example, if a person is hanging various objects onto a J-hook 12 that is mounted to a slot board 62, the person may inadvertantly move the suspended object laterally a moderate amount, thus pulling the J-hook 12 from the slot board 62.

One solution to this problem would be to provide special fasteners particularly designed to eliminate this lateral instability as described above. However, it is difficult to provide such a special fastener which would also be compatible for use with the conventional pegboard 10.

It is with the foregoing in mind that the present invention was created. The present invention permits the use of a J-hook which can have substantially the same configuration as the conventional J-hook 12 and which can function in mounting an object to a pegboard 10 in a manner of the common prior art J-hook 12. In addition, the present invention provides an adapter generally designated 80, to be used in combination with the J-hook 12 and the slot board 62 so as to provide a reliable mounting assembly.

In the following description, the J-hook of the present invention will be given the same numerical designations as the convention prior art J-hook 12 described previously herein. However, it is to be understood that the precise configuration and dimensioning of the J-hook 12 of the present invention woud be controlled within closer limits to make it compatible with the configuration of the adapter 80 and the configuration of the slot board 62.

Figure 8:
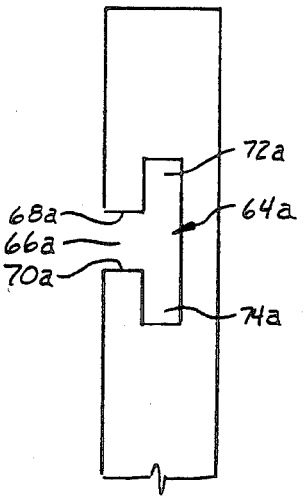
FIG. 8 Prior Art
FIGS. 8 and 9 are side elevational views of two other configurations of prior art slot boards.

Before describing the adapter 80 used in the combination of the present invention, to appreciate certain features of the present invention, it should be recognized that the configuration of the slots in a slot board are not uniform. For example, in FIG. 8, there is shown a slot configuration somewhat similar to that of FIG. 7. Components of the slot of FIG. 8 will be given numerical designations similar to the slot of FIG. 7, with an "a" suffix distinguishing the slot of FIG. 8. The slot **64*a* has the main passageway portion 66*a* and the upper and lower recesses 72*a* and 74*a*. However, the upper and lower surfaces 68*a* and 70*a*, respectively, are arranged parallel to one another, rather than being sloped as shown in FIG. 7**.

Figure 9:
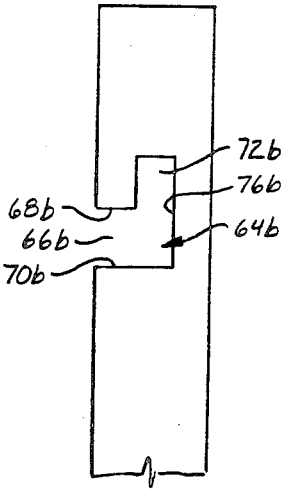
FIG. 9 Prior Art

In FIG. 9, there is shown another possible configuration of a slot, and the components of this slot will be distinguished by a "b" suffix. The slot **64*b* has the front slot portion 66*b* defined by upper and lower parallel, horizontally aligned surfaces 68*b* and 70*b*. However, there is only an upper recess 72*b* rearwardly of the slot opening portion 66*b*. The lower surface 70*b* is extended rearwardly to the rear surface 76*b* of the slot 64*b***.

To describe the adapter 80 of the present invention, this adapter 80 is conveniently made as a substantially rigid molded plastic piece. In terms of structure, the adapter 80 comprises a front plate 82 and a rear mounting member 84.

The plate 82 has a generally planar rectangular configuration with a relatively small thickness dimension (e.g. 1/16th inch). The top and bottom edges of the plate 82 are designated 86 and 88, respectively, and the side edges 90. The plate 82 is formed with a vertical cutout 92 extending from a central location at the top edge 86 and reaching downwardly a distance of about $\frac{1}{4}$ to $\frac{1}{3}$ of the total depth dimension of the plate 82. The width of the cutout 92 is just slightly greater than the width of the J-hook 12.

The front face of the plate 82 is formed with two ridges or flanges 94 spaced from one another at a distance slightly greater than the width dimension of the shank 16 of the J-hook 12. Further, the surface 96 between the two ridges 94 is curved in a horizontal, cross-sectional configuration to match the cylindrical curvature of the shank 16.

The mounting member 84 has the overall configuration of a right angle rectangular prism, the front face of which is joined integrally with the plate 82. Thus, the mounting member 84 has top and bottom flat surfaces 98 and 100, respectively, side surfaces 102, and a rear surface 104.

Figure 10:
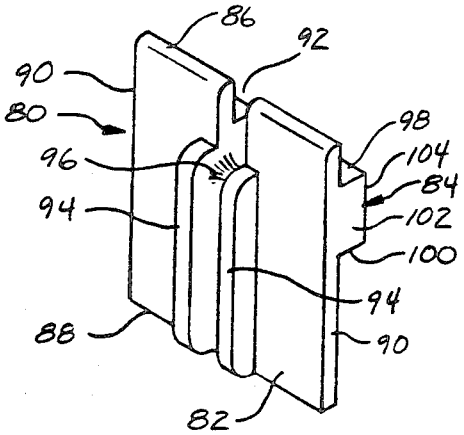
FIG. 10 is an isometric view of an adapter particularly made for use in the combination of the present invention.
Figure 11:
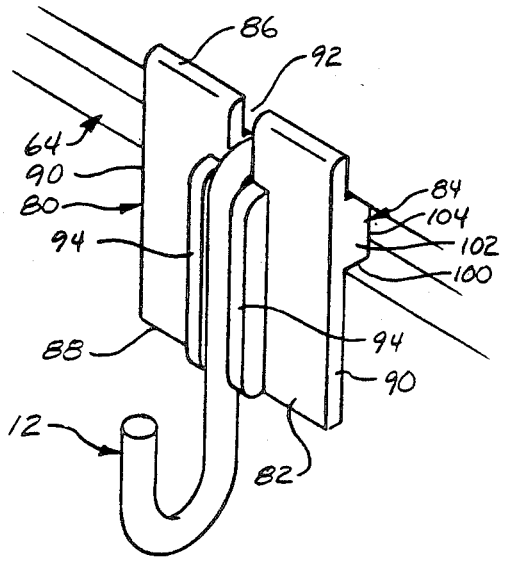
FIG. 11 is an isometric view similar to FIG. 10, showing the adapter in combination with a slot board and J-hook-like hanging member in accordance with the teachings of the present invention.
Figure 12:
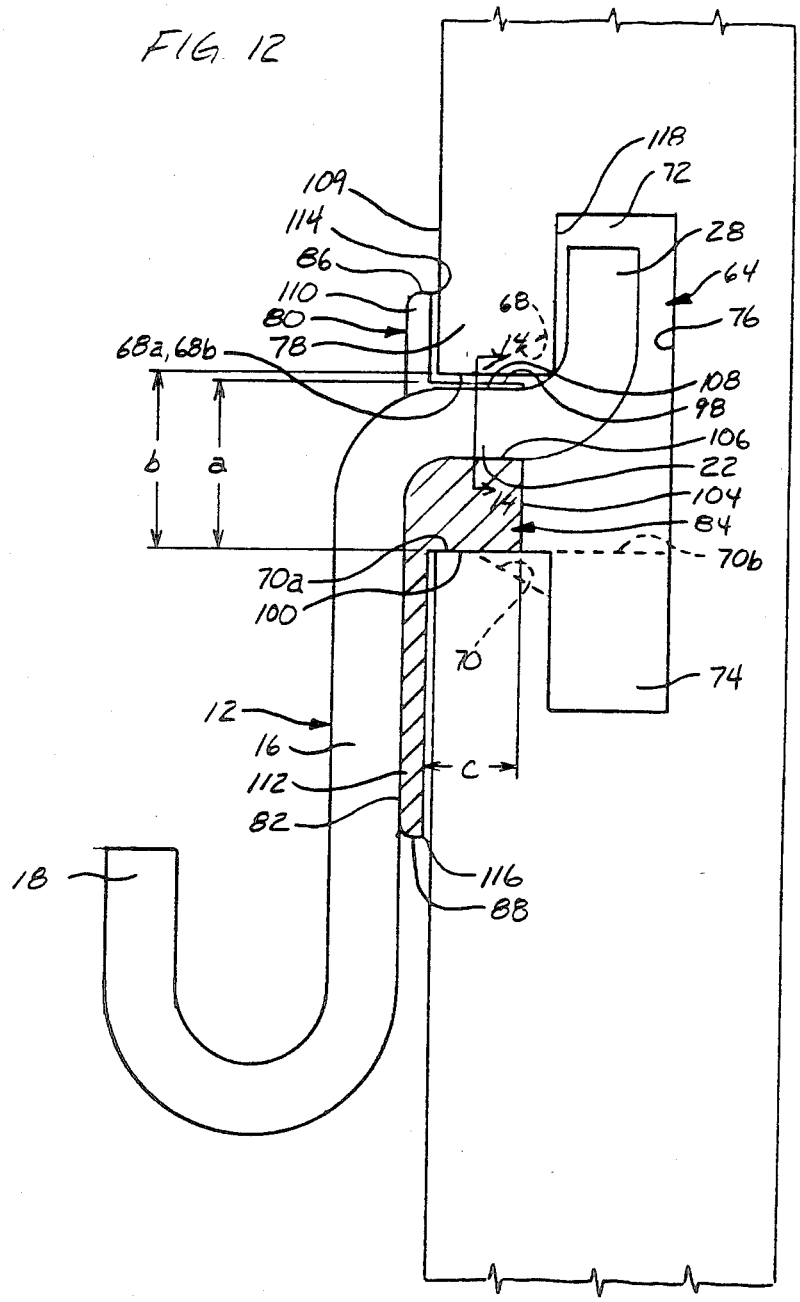
FIG. 12 is a side elevational view of the combination of the present invention, with a portion of the adapter being broken away in section.

The positioning and configuration of this mounting member 84 are critical in the present invention. First, the top and bottom surfaces 98 and 100 are spaced from one another by a distance (indicated at "a" in FIG. 12) slightly less than the spacing between the upper and lower slot defining surfaces 68–70, **68*a*–70*a*, or 68*b*–70*b*. To illustrate how the adapter 80 of the present invention interfits with slot boards having the various slot configurations, all three of the variations are shown in FIG. 12, with the slot configuration of FIG. 8 being shown in full line, and the variations of the slot configurations of FIGS. 7 and 10 being shown in broken lines. The vertical dimension of the slot portion 66, 66*a* or 66*b* is indicated at "b" in FIG. 11. The horizontal thickness dimension (indicated at "c") in FIG. 11 should be sufficiently large so that when the J-hook 12 is tilted outwardly so as to tend to pull the adapter 80 outwardly from the slot 64, the lower surface 100 of the mounting member 84 remains in bearing relationship with the lower surface 70, 70*a* or 70*b* that defines the lower limit of the slot portion 66, 66*a* or 66*b*. In general, the horizontal width dimension "c" should be at least approximately one-half of the height dimension of "b" of the slot portion 66, 66*a* or 66*b***.

The upper middle portion of the mounting member 84 is provided with a longitudinally slot-like recess 106 to receive the interconnecting member 22 of the J-hook 12. This slot 106 is positioned and dimensioned so that with the J-hook 12 in place, as illustrated in FIG. 12, the top surface 108 of the interconnecting portion 22 of the J-hook 12 is a moderate distance below the top slot defining surface 68, **68*a* or 68*b*. In effect, this slot 106 is a rearward extension of the lower portion of the lower part of the cutout 92 formed in the plate 82**.

The operation of the present invention will be described with reference to the slot configuration indicated at 64. Initially, the adapter 80 is placed so that the mounting member 84 extends into the front slot opening portion 66, and so that the plate 82 presses against the front surface 109 of the slot board 62. It will be noted that in terms of the operating characteristics of the adapter 80, the plate 82 can be considered as having two functional components, namely an upper plate portion 110 and a lower plate portion 112. In the event that the lower plate portion 112 is rotated outwardly away from the front surface 108 of the slot board 62, the upper rear edge portion 114 of the upper plate portion 110 bears against the slot board surface 108 and acts as a fulcrum or center of rotation for the lower surface 100 of the mounting member 84 of the adapter 80. This causes the mounting member 84 to remain more horizontal during the outward movement of a lower part 112 of the plate 82.

In like manner, if the upper plate portion 110 tends to move outwardly, relative to the lower plate portion 112, the lower edge 116 of the plate member 112 tends to bear against the slot board surface 109, also to cause the movement of the mounting member 84 to be more nearly horizontal. The significance of this in maintaining proper engagement of the J-hook to the slot board 62 will become more apparent as this explanation continues.

After the adapter 80 has been put in place, the J-hook 12 is inserted by placing the shank 16 horizontally and inserting the finger 28 through the lower part of the plate cutout 92 and through the recess 106 formed in the mounting member 84. As the interconnecting portion 22 of the J-hook 12 comes quite close to the front surface 109, the hook portion 18 of the J-hook 12 is rotated downwardly so that the finger 28 moves upwardly behind the rearwardly facing surface 118 of the flange 78.

With the J-hook so mounted to the slot board 62 in combination with the adapter 80, a tension or pulling force can be exerted on the hook 18 in a downward direction, in a downward and outward direction, and also a downward direction having a sideways force component, without dislodging the J-hook 12 from the board 62. For example, let it be assumed that the hook portion 18 has an object attached thereto which is spaced outwardly from the front surface 108 of the board 62, so that the net tension force on the hook portion 18 is downwardly and outwardly, as illustrated in FIG. 13. In this arrangement, the finger 28 bears against the rear part of the flange 78, while the lower rear part of the interconnecting portion 22 bears against the upwardly facing surface of the recess 106 formed in the mounting member 84. A lateral movement of the hook portion 18 (i.e. to the right or the left, generally parallel to the board surface 109) is resisted by the interaction of the edges forming the plate slot or cutout 92 and the side surfaces that define the recess 106 in the mounting member 84. It is only when the angle of the pulling force on the hook portion 18 becomes more nearly horizontal that the hook 12 finally pulls loose from the slot board 62.

On the other hand, if the load on the J-hook 12 is expected to be a straight vertical load, with no forward or lateral force components, then the J-hook 12 can be used in the slot board 62 without the adpater. Also, if it is desired to mount an object to a conventional pegboard, then the J-hook 12 can be used without the adapter 80 to accomplish this mounting.

It is to be recognized that various modifications could be made to the present invention without departing from the basic teachings thereof.

We claim:

1. A mounting assembly adapted to support objects, such as objects for display or convenient access, said assembly comprising:

a. a slot board having a generally vertically aligned front face and defining at a slot location a horizontal retaining slot opening to said front face, said board having a downwardly extending upper flange at said front face, said flange having a first downwardly facing upper surface defining an upper portion of said slot, and a second rear surface extending upwardly from said first surface with a substantial vertical component of alignment, said board having a third lower surface spaced below said first surface and defining a lower limit of said slot, said slot having a height dimension extending from said third lower surface to said first upper surface, and a width dimension extending from the front face at a location of said flange to said second surface;

b. a hanging member adapted to be mounted to the board at said slot location, said hanging member being a substantially rigid member comprising:

1. an elongate shank having a lengthwise axis and adapted to be extending downwardly from the slot location of the board when the hanging member is in its operating position relative to the board, said shank having an upper end and also a lower end which is arranged to attach to an object to be supported;
2. an interconnecting portion having a first end connecting to the upper end of the shank and extending laterally therefrom to a second end of the interconnecting portion, said interconnecting portion having a major alignment component perpendicular to the lengthwise axis of the shank;
3. a retaining finger having a lower end connecting to the second end of the interconnecting portion and extending upwardly therefrom, said finger having a lengthwise axis having a major alignment component perpendicular to said interconnecting portion;

c. a substantially rigid adapter to interfit with said slot board and said hanging member in an operational position so as to securely mount the hanging member to the board, said adapter comprising:

1. front plate means adapted to be positioned in said operating position forwardly of the front face of the board at the slot location, and comprising an upper plate means portion to engage the front face of the board above said slot, and a lower plate means portion adapted to engage the front face of the board below said slot;
2. a mounting member fixedly connected to the plate means and extending rearwardly therefrom, said mounting member having a substantially horizontal lower surface extending rearwardly from said plate means and adapted to bear against said third lower surface of the slot board, and an upper portion positioned adjacent to said first upper surface of the board when in said operating position;

d. said plate means and the upper portion of the mounting member defining a forwardly to rearwardly extending, open, horizontal recess configured to receive the interconnecting portion of the hanging member in a manner to restrain lateral movement of said interconnecting portion and so as to position said interconnecting portion adjacent to said first upper surface of the slot board;

e. said assembly being characterized in that with the slot board, the hanging member and the adapter in an assembled position, the adapter is positioned at said slot location with the plate means bearing against the front face of the board, the mounting member is positioned in said slot with the lower surface of the mounting member bearing against the third surface of the slot board, the hanging member is positioned relative to said adapter and said slot board so that the hanging member interfits with the adapter and said shank extends generally downwardly from the slot location, the interconnecting portion is positioned within said horizontal recess, and said finger extends upwardly adjacent the rear surface of said flange, f. said mounting member being characterized in that with the mounting member positioned in said slot in said operating position and with the plate means positioned against the front face of the board, but without the hanging member being positioned in interfitting relationship with the adapter, the lower surface of the mounting member can pass unobstructedly forwardly over the third lower surface of the slot board, so that the adapter can be moved unobstructedly in a substantially forward direction away from said slot board, g. said assembly being further characterized in that with the assembly in the assembled position, when a downward and laterally forward force is exerted on the shank of the hanging member, 1. the finger of the hanging member exerts a forward force component against the second rear surface of the slot board so as to be restrained from further forward movement,
2. the interconnecting portion of the hanging member bears downwardly against the mounting member of the adapter, which in turn bears against the third lower surface of the slot board,
3. any downward and forward force component exerted on the mounting member of the adapter which tends to rotate the lower plate means portion forwardly is resisted primarily by the upper plate means portion bearing rearwardly against the front face of the slot board above the slot, which in turn tends to cause said mounting member to move substantially forwardly from the slot, with such forward motion of the mounting member and the hanging member being resisted by the finger of the hanging member bearing against the slot board at the second rear surface.

2. The assembly as recited in claim 1, wherein the lower plate means portion defines a vertically aligned groove postioned and configured to extend downwardly from a forward end of said horizontal recess so as to receive therein said shank.

3. The assembly as recited in claim 2, wherein said lower plate means portion has vertically aligned ridge means defining said groove.

4. The assembly as recited in claim 1, wherein said mounting member has a horizontal thickness dimension extending from a rear surface of said plate means to a rear end of the lower surface of said mounting member, said horizontal thickness dimension being at least approximately one-half of a height dimension extending from said first upper surface to the third lower surface of the board.

5. The assembly as recited in claim 4, wherein said mounting member has an upper surface, and a vertical distance from the lower surface to the upper surface of the mounting member is only moderately less than a vertical dimension between the first upper surface and the third lower surface of the board, whereby, with the adapter in its operating position, vertical movement of the adapter relative to the slot is restrained.

6. The assembly as recited in claim 1, wherein:

a. the lower plate means portion defines a vertically aligned groove positioned and configured to extend downwardly from a forward end of said horizontal recess so as to receive therein said shank;

b. said lower plate means portion has vertically aligned ridge means defining said groove;

c. said mounting member has a horizontal thickness dimension extending from a rear surface of said plate means to a rear end of the lower surface of said mounting member, said horizontal thickness dimension being at least approximately one-half of a height dimension extending from said first upper surface to the third lower surface of the board; and d. said mounting member has an upper surface, and a vertical distance from the lower surface to the upper surface of the mounting member is only moderately less than a vertical dimension between the first upper surface and the third lower surface of the board, whereby, with the adapter in its operating position, vertical movement of the adapter relative to the slot is restrained.

7. A mounting adapter adapted to be used in supporting objects, such as objects for display or convenient access, by being used in conjunction with:

a. a slot board having a generally vertically aligned front face and defining at a slot location a horizontal retaining slot opening to said front face, said board having a downwardly extending upper flange at said front face, said flange having a first downwardly facing upper surface defining an upper portion of said slot, and a second rear surface extending upwardly from said first surface with a substantial vertical component of alignment, said board having a third lower surface spaced below said first surface and defining a lower limit of said slot, said slot having a height dimension extending from said third lower surface to said first upper surface, and width dimension extending from the front face at a location of said flange to said second surface;

b. a hanging member adapted to be mounted to the board at said slot location, said hanging member being a substantially rigid member comprising:

1. an elongate shank having a lengthwise axis and adapted to be extending downwardly from the slot location of the board when the hanging member is in its operating position relative to the board, said shank having an upper end and also a lower end which is arranged to attach to an object to be supported;

2. an interconnecting portion having a first end connecting to the upper end of the shank and extending laterally therefrom to a second end of the interconnecting portion, said interconnecting portion having a major alignment component perpendicular to the lengthwise axis of the shank;

3. a retaining finger having a lower end connecting to the second end of the interconnecting portion and extending upwardly therefrom, said finger having a lengthwise axis having a major alignment component perpendicular to said interconnecting portion;

said adapter being a substantially rigid adapter to interfit with said slot board and said hanging member in an operating position so as to securely mount the hanging member to the board, said adapter comprising:

a. front plate means adapted to be positioned in said operating position forwardly of the front face of the board at the slot location, and comprising an upper plate means portion to engage the front face of the board above said slot, and a lower plate means portion adapted to engage the front face of the board below said slot;

b. a mounting member fixedly connected to the plate means and extending rearwardly therefrom, said mounting member having a substantially horizontal lower surface extending rearwardly from said plate means and adapted to bear against said third lower surface of the slot board, and an upper portion positioned adjacent to said first upper surface of the board when in said operating position;

c. said plate means and the upper portion of the mounting member defining a forwardly to rearwardly extending, open, horizontal recess configured to receive the interconnecting portion of the hanging member in a manner to restrain lateral movement of said interconnecting portion and so as to position said interconnecting portion adjacent to said first upper surface of the slot board;

d. said adapter being characterized in that it can be assembled with said slot board and said hanging member in as assembled position to form an assembly in a manner that the adapter is positioned at said slot location with the plate means bearing agaist the front face of the board, the mounting member is positioned in said slot with the lower surface of the mounting member bearing against the third surface of the slot board, the hanging member is positioned relative to said adapter and said slot board so that said shank extends generally downwardly from the slot location, the interconnecting portion is positioned within said horizontal recess, and said finger extends upwardly adjacent the rear surface of said flange, e. said mounting member being characterized in that with the mounting member positioned in said slot in said operating position and with the plate means positioned against the front face of the board, but without the hanging member being positioned in interfitting relationship with the adatper, the lower surface of the mounting member can pass unobstructedly forwardly over the third lower surface of the slot board, so that the adapter can be moved unobstructedly in a substantially forward direction away from said slot board, f. said adapter being further characterized in that with the assembly in the assembled position, when a downward and laterally forward force is exerted on the shank of the hanging member, 1. the finger of the hanging member exerts a forward force component against the second rear surface of the slot board so as to be restrained from further forward movement, 2. the interconnecting portion of the hanging member bears downwardly against the mounting member of the adapter, which in turn bears against the third lower surface of the slot board, 3. any downward and forward force component exerted on the mounting member of the adapter which tends to rotate the lower plate means portion forwardly is resisted primarily by the upper plate means portion bearing rearwardly against the front face of the slot board above the slot, which in turn tends to cause said mounting member to move substantially forwardly from the slot, with such forward motion of the mounting member and the hanging member being resisted by the finger of the hanging member bearing against the slot board at the second rear surface.

8. The adapter as recited in claim 7, wherein the lower plate means portion defines a vertically aligned groove positioned and configured to extend downwardly from a forward end of said horizontal recess so as to receive therein said shank.

9. The adapter as recited in claim 8, wherein said lower plate means portion has vertically aligned ridge means defining said groove.

10. The adapter as recited in claim 7, wherein said mounting member has a horizontal thickness dimension extending from a rear surface of said plate means to a rear end of the lower surface of said mounting member, said horizontal thickness dimension being at least approximately one-half of a height dimension extending from said first upper surface to the third lower surface of the board.

11. The adapter as recited in claim 10, wherein said mounting member has an upper surface, and a vertical distance from the lower surface to the upper surface of the mounting member is only moderately less than a vertical dimension between the first upper surface and the third lower surface of the board, whereby, with the adapter in its operating position, vertical movement of the adapter relative to the slot is restrained.

12. The adapter as recited in claim 7, wherein:

a. the lower plate means portion defines a vertically aligned groove positioned and configured to extend downwardly from a forward end of said horizontal recess so as to receive therein said shank;

b. said lower plate means portion has vertically aligned ridge means defining said groove;

c. said mounting member has a horizontal thickness dimension extending from a rear surface of said plate means to a rear end of the lower surface of said mounting member, said horizontal thickness dimension being at least approximately one-half of a height dimension extending from said first upper surface to the third lower surface of the board; and d. said mounting member has an upper surface, and a vertical distance from the lower surface to the upper surface of the mounting member is only moderately less than a vertical dimension between the first upper surface and the third lower surface of the board, whereby, with the adapter in its operating position, vertical movement of the adapter relative to the slot is restrained.

13. A method of mounting objects, such as for display or convenient access, said method comprising:

a. providing a slot board having a generally vertically aligned front face and defining at a slot location a horizontal retaining slot opening to said front face, said board having a downwardly extending upper flange at said front face, said flange having a first downwardly facing upper surface defining an upper portion of said slot, and a second rear surface extending upwardly from said first surface with a substantial vertical component of alignment, said board having a third lower surface spaced below said first surface and defining a lower limit of said slot, said slot having a height dimension extending from said third lower surface to said first upper surface, and a width dimension extending from the front face at a location of said flange to said second surface;

b. providing a hanging member, said hanging member being a substantially rigid member comprising:

1. an elongate shank having a lengthwise axis, said shank having an upper end and also a lower end which is arranged to attach to an object to be supported;

2. an interconnecting portion having a first end connecting to the upper end of the shank and extending laterally therefrom to a second end of the interconnecting portion, said interconnecting portion having a major alignment component perpendicular to the lengthwise axis of the shank;

3. a retaining finger having a lower end connecting to the second end of the interconnecting portion and extending upwardly therefrom, said finger having a lengthwise axis having a major alignment component perpendicular to said interconnecting portion;

c. providing a substantially rigid adapter to interfit with said slot board and said hanging member in an operating position so as to securely mount the hanging member to the board, said adapter comprising:

1. front plate means adapted to be positioned in said operating position forwardly of the front face of the board at the slot location, and comprising an upper plate means portion to engage the front face of the board above said slot, and a lower plate means portion adapted to engage the front face of the board below said slot;

2. a mounting member fixedly connected to the plate means and extending rearwardly therefrom, said mounting member having a lower surface adapted to bear against said third lower surface of the slot board and an upper portion positioned adjacent to said first upper surface of the board;

d. providing said plate means and the upper portion of the mounting member so as to define a forwardly to rearwardly extending, open, horizontal recess configured to receive the interconnecting portion of the hanging member in a manner to restrain lateral movement of said interconnecting portion and so as to position said interconnecting portion adjacent to said first upper surface of the slot board;

e. assembling the hanging member and the adapter with the slot board in an assembled position to form an assembly by 1. positioning said adapter at said slot location with the plate means bearing against the front face of the board and with the mounting member being positioned in said slot with the lower surface of the mounting member bearing against the third surface of the slot board;

2. positioning said hanging member relative to said adapter and said slot board so that said shank extends generally downwardly from the slot location, said interconnecting portion is positioned within said horizontal recess, and said finger extends upwardly adjacent the rear surface of said flange, to form said assembly;

f. said mounting member being characterized in that with the mounting member positioned in said slot in said operating position and with the plate means positioned against the front face of the board, but without the hanging member being positioned in interfitting relationship with the adapter, the lower surface of the mounting member can pass unobstructedly forwardly over the third lower surface of the slot board, so that the adapter can be moved unobstructedly in a substantially forward direction away from said slot board, g. said assembly being further characterized in that with the assembly in the assembled position, when a downward and laterally forward force is exerted on the shank of the hanging member, 1. the finger of the hanging member exerts a forward force component against the second rear surface of the slot board so as to be restrained from further forward movement, 2. the interconnecting portion of the hanging member bears downwardly against the mounting member of the adapter, which in turn bears against the third lower surface of the slot board, 3. any downward and forward force component exerted on the mounting member of the adapter which tends to rotate the lower plate means portion forwardly is resisted primarily by the upper plate means portion bearing rearwardly against the front face of the slot board above the slot, which in turn tends to cause said mounting member to move substantially forwardly from the slot, with such forward motion of the mounting member and the hanging member being resisted by the finger of the hanging member bearing against the slot board at the second rear surface.

14. The method as recited in claim 13, wherein the lower plate means portion is provided with a vertcally aligned groove positioned and configured to extend downwardly from a forward end of said horizontal recess so as to receive therein said shank.

15. The method as recited in claim 14, wherein said lower plate means portion has vertically aligned ridge means defining said groove.

16. The method as recited in claim 13, wherein said mounting member is provided with a horizontal thickness dimension extending from a rear surface of said plate means to a rear end of the lower surface of said mounting member, said horizontal thickness dimension being at least approximately one-half of a height dimension extending from said first upper surface to the third lower surface of the board.

17. The method as recited in claim 16, wherein said mounting member has an upper surface, and a vertical distance from the lower surface to the upper surface of the mounting member is only moderately less than a vertical dimension between the first upper surface and the third lower surface of the board, whereby, with the adpater in its operating position, vertical movement of the adapter relative to the slot is restrained.

18. The method as recited in claim 1, wherein:

a. the lower plate means portion is provided with a vertically aligned groove positioned and configured to extend downwardly from a forward end of said horizontal recess so as to receive therein said shank;

b. said lower plate means portion has vertically aligned ridge means defining said groove;

c. said mounting member is provided with a horizontal thickness dimension extending from a rear surface of said plate means to a rear end of the lower surface of said mounting member, said horizontal thickness dimension being at least approximately one-half of a height dimension extending from said first upper surface to the third lower surface of the board; and d. said mounting member has an upper surface, and a vertical distance from the lower surface to the upper surface of the mounting member is only moderately less than a vertical dimension between the first upper surface and the third lower surface of the board, whereby, with the adapter in its operating position, vertical movement of the adapter relative to the slot is restrained.

* * * * *